US010932542B2

(12) United States Patent
Komiyama

(10) Patent No.: US 10,932,542 B2
(45) Date of Patent: Mar. 2, 2021

(54) CHEMICAL SOLUTION SUPPLY APPARATUS AND CHEMICAL SOLUTION SUPPLY IMPLEMENT

(71) Applicant: KOBAYASHI PHARMACEUTICAL CO., LTD., Osaka (JP)

(72) Inventor: Satoru Komiyama, Osaka (JP)

(73) Assignee: KOBAYASHI PHARMACEUTICAL CO., LTD., Osaka (JP)

( * ) Notice: Subject to any disclaimer, the term of this patent is extended or adjusted under 35 U.S.C. 154(b) by 49 days.

(21) Appl. No.: 15/781,921

(22) PCT Filed: Dec. 9, 2016

(86) PCT No.: PCT/JP2016/086782
§ 371 (c)(1),
(2) Date: Jun. 6, 2018

(87) PCT Pub. No.: WO2017/099236
PCT Pub. Date: Jun. 15, 2017

(65) Prior Publication Data

US 2018/0360193 A1 Dec. 20, 2018

(30) Foreign Application Priority Data

Dec. 10, 2015 (JP) ..... JP2015-241553

(51) Int. Cl.
*A45D 34/04* (2006.01)
*B65D 47/42* (2006.01)
(Continued)

(52) U.S. Cl.
CPC ..... *A45D 34/042* (2013.01); *A45D 34/04* (2013.01); *A45D 34/043* (2013.01);
(Continued)

(58) Field of Classification Search
CPC .... A45D 34/042; A45D 34/041; B05C 17/00; B05C 17/002; B65D 47/248; B65D 47/42; B65D 83/48; B65D 83/46
(Continued)

(56) References Cited

U.S. PATENT DOCUMENTS 1,687,647 A 10/1926 Garvey
2,210,662 A 8/1940 Garvey
(Continued)

FOREIGN PATENT DOCUMENTS

CN 1288433 A 3/2001
CN 101415617 A 4/2009
(Continued)

OTHER PUBLICATIONS

International Search Report for International Application No. PCT/JP2016/086782 dated Jan. 17, 2017 (2 Sheets).
(Continued)

*Primary Examiner* — Paul R Durand
*Assistant Examiner* — Robert K Nichols, II
(74) *Attorney, Agent, or Firm* — Kratz, Quintos & Hanson, LLP

(57) ABSTRACT

A chemical solution supply apparatus (1) includes a container (10) and a chemical solution supply implement (20) that can, in a state of being connected to a mouth portion (14), switch over a state where the container (10) is sealed and a state where a chemical solution in a storage portion (12) is allowed to be supplied to the outside of the container (10). The chemical solution supply implement (20) has a base (30) and a supply body (50). The base (30) has a retaining portion (40), a pressing portion (42), and a restricting portion (34) that restricts displacement of the supply body (50) with coming into contact with the supply body (50) when the supply body (50) is pressed against pressing
(Continued)

force of the pressing portion (42). The supply body (50) moves away from the retaining portion (40), thereby forming a supply flow passage, and comes into contact with the retaining portion (40), thereby blocking the supply flow passage.

19 Claims, 14 Drawing Sheets

(51) Int. Cl.

| | |
|---|---|
| ***B05C 17/00*** | (2006.01) |
| ***A61J 1/05*** | (2006.01) |
| ***A45D 40/26*** | (2006.01) |
| *A61J 1/14* | (2006.01) |
| *B65D 81/32* | (2006.01) |

(52) U.S. Cl.
CPC ..... *A45D 40/264* (2013.01); *A61J 1/05* (2013.01); *B05C 17/00* (2013.01); *B05C 17/002* (2013.01); *B65D 47/42* (2013.01); *A45D 2200/1009* (2013.01); *A45D 2200/1018* (2013.01); *A61J 1/1487* (2015.05); *B65D 81/3266* (2013.01)

(58) Field of Classification Search
USPC ..... 401/206, 214, 213, 202, 195; 222/402.21–402.23, 495–497
See application file for complete search history.

(56) References Cited

U.S. PATENT DOCUMENTS

| | | | | |
|---|---|---|---|---|
| 2,975,466 | A | 3/1961 | Fillmore | |
| 3,263,265 | A * | 8/1966 | Judson | D06B 1/02 401/269 |
| 3,336,626 | A | 8/1967 | Schaich | |
| 3,468,611 | A | 9/1969 | Ward | |
| 3,520,450 | A | 7/1970 | Prussin | |
| 3,690,515 | A | 9/1972 | Ewald | |
| 4,089,609 | A | 5/1978 | Gring | |
| 4,359,292 | A | 11/1982 | Thompson | |
| 4,848,947 | A | 7/1989 | Kremer | |
| 5,056,949 | A | 10/1991 | Petrillo | |
| 5,897,267 | A | 4/1999 | Poolman | |
| 6,179,505 | B1 | 1/2001 | Oder, III | |
| 6,267,273 | B1 | 7/2001 | Suzuki | |
| 9,955,766 | B2 * | 5/2018 | Bell | A45D 34/041 |
| 2004/0005186 | A1 | 1/2004 | Ueda | |
| 2009/0173755 | A1 | 7/2009 | Ogawa | |
| 2010/0084397 | A1 | 4/2010 | Kubo | |
| 2012/0034017 | A1 * | 2/2012 | Archer | A61K 8/06 401/214 |

FOREIGN PATENT DOCUMENTS

| | | | |
|---|---|---|---|
| CN | 101541292 | A | 9/2009 |
| CN | 105073603 | A | 11/2015 |
| DE | 10211483 | A1 | 9/2003 |
| FR | 2799740 | A1 | 4/2001 |
| GB | 1515078 | A | 6/1978 |
| JP | S51-047562 | Y | 11/1976 |
| JP | H05-024574 | U | 3/1993 |
| JP | H08-207952 | A | 8/1996 |
| JP | H08217123 | A | 8/1996 |
| JP | 2002-160755 | A | 6/2002 |
| JP | 2005-132423 | A | 5/2005 |
| WO | 96/37126 | A1 | 11/1996 |

OTHER PUBLICATIONS

Office Action of U.S. Appl. No. 15/781,906 dated Jan. 14, 2020 (19 sheets).
Office Action of U.S. Appl. No. 15/781,906 dated Apr. 1, 2019 (14 pages).
Extended European Search Report for European Patent Application No. 16873129.7 dated Jul. 18, 2019 (11 sheets).
Extended European Search Report for European Patent Application No. 16873128.9 dated Jul. 22, 2019 (9 sheets).
Office Action of related U.S. Appl. No. 15/781,906 dated Sep. 23, 2020 (12 sheets).

* cited by examiner

CHEMICAL SOLUTION SUPPLY APPARATUS AND CHEMICAL SOLUTION SUPPLY IMPLEMENT

TECHNICAL FIELD

The present invention relates to a chemical solution supply apparatus for supplying a chemical solution.

BACKGROUND ART

Chemical solution supply apparatuses for supplying a chemical solution to a part to be supplied, such as skin, have been known. For example, Patent Literature 1 discloses a chemical solution applicator including a container for containing a chemical solution, a plug body connected to the container, an inner lid connected to the plug body, and a sponge. The plug body is connected (press-fitted) to the mouth of the container. An outlet of the chemical solution is formed in the inner lid. An outlet portion of the inner lid surrounding the outlet is formed in a shape inclined so that the outlet gradually becomes smaller from the inside to the outside of the container. A spring and a movable valve are connected to the plug body. The spring urges the movable valve from the inside of the inner lid to the inner lid. The movable valve has a shoulder portion having a shape to have surface contact with the outlet portion and a protruding portion protruding from the shoulder portion toward the outside of the container. The outer shape of the protruding portion is set to be smaller than the outlet, and the protruding portion has a shape protruding to the outside from the outer surface of the inner lid. The outer edge of the sponge is fixed to the outer edge of the inner lid. The sponge is maintained in a shape that bulges to protrude outward by being urged by the protruding portion from the inside toward the outside.

The application of the chemical solution to skin using this chemical solution applicator is carried out in the following manner, for example. First, an outer surface of the sponge is pressed against the skin in a position with the outer surface facing downward. At this time, a gap is formed between the outlet portion and the shoulder portion by the protruding portion being pressed toward the inside of the inner lid against the urging force of the spring, so that the chemical solution in the container flows out to the outside of the inner lid through the outlet. This chemical solution is impregnated with the sponge. Thereafter, the chemical solution applicator in that state is moved sideways along the skin. As a result, the chemical solution held in the sponge is applied to the skin.

In the chemical solution supply apparatus as described in Patent Literature 1, clogging of the sponge may be caused by dirt on a part (such as skin) to be supplied adhering to the sponge, resulting in an insufficient supply amount of the chemical solution.

Thus, it is considered not to use (remove) the sponge. However, when the sponge is simply removed, the supply amount of the chemical solution becomes excessive. Specifically, the sponge has a function of being impregnated with (holding) the chemical solution and a function of supplying a substantially constant quantity of chemical solution to a part to be supplied (such as skin). Thus, when the sponge is removed, the whole quantity of the chemical solution flowing out through the outlet is supplied to a part to be supplied at a stroke. This is more conspicuous as the pressing amount of the movable valve increases.

CITATION LIST

Patent Literature

Patent Literature 1: Japanese Examined Utility Model Publication No. S51-47562

SUMMARY OF INVENTION

It is an object of the present invention to provide a chemical solution supply apparatus and a chemical solution supply implement which can achieve both the avoidance of insufficient supply of a chemical solution and the prevention of excessive supply of the chemical solution.

Means for Solving the Problem

A chemical solution supply apparatus according to one aspect of the present invention comprises a container having a storage portion for storing a chemical solution, a mouth portion joining the storage portion and opening in a specific direction, and a chemical solution supply implement which is connectable to the mouth portion and which is, in a state of being connected to the mouth portion, operable to switch over a state where the container is sealed and a state where the chemical solution in the storage portion is allowed to be supplied to the outside of the container. The chemical solution supply implement has a base connectable to the mouth portion and having a shape allowing communication between the inside of the container and the outside of the container, and a supply body held in the base for closing the container and supplying the chemical solution to a part to be supplied. The base has a retaining portion that comes into contact with the supply body from a side opposite to the storage portion with reference to the mouth portion to prevent detachment of the supply body from the base, a pressing portion that presses the supply body to the retaining portion to close the container, and a restricting portion that restricts displacement of the supply body with coming into contact with the supply body when the supply body is pressed against pressing force of the pressing portion. The supply body moves away from the retaining portion, thereby forming a supply flow passage of the chemical solution to the outside of the container between the supply body and the retaining portion, and comes into contact with the retaining portion, thereby blocking the supply flow passage.

A chemical solution supply implement according to another aspect of the present invention is connectable to a mouth portion of a container having a storage portion for storing a chemical solution and the mouth portion joining the storage portion and opening in a specific direction, and which is, in a state of being connected to the mouth portion, operable to switch over a state where the container is sealed and a state where the chemical solution in the storage portion is allowed to be supplied to the outside of the container. The chemical solution supply implement includes a base connectable to the mouth portion and having a shape allowing communication between the inside of the container and the outside of the container, and a supply body held in the base for closing the container and supplying the chemical solution to a part to be supplied. The base has a retaining portion that comes into contact with the supply body from a side opposite to the storage portion with reference to the mouth portion to prevent detachment of the supply body from the base, a pressing portion that presses the supply body to the retaining portion to close the container, and a restricting portion that restricts displacement of the supply body with coming into contact with the supply body when the supply body is pressed against pressing force of the pressing portion. The supply body moves away from the retaining portion, thereby forming a supply flow passage of the chemical solution to the outside of the container between the supply body and the retaining portion, and comes into contact with the retaining portion, thereby blocking the supply flow passage.

DESCRIPTION OF EMBODIMENTS

First Embodiment

A chemical solution supply apparatus 1 according to a first embodiment of the present invention will be described with reference to FIGS. 1 to 8.

Figure 1:
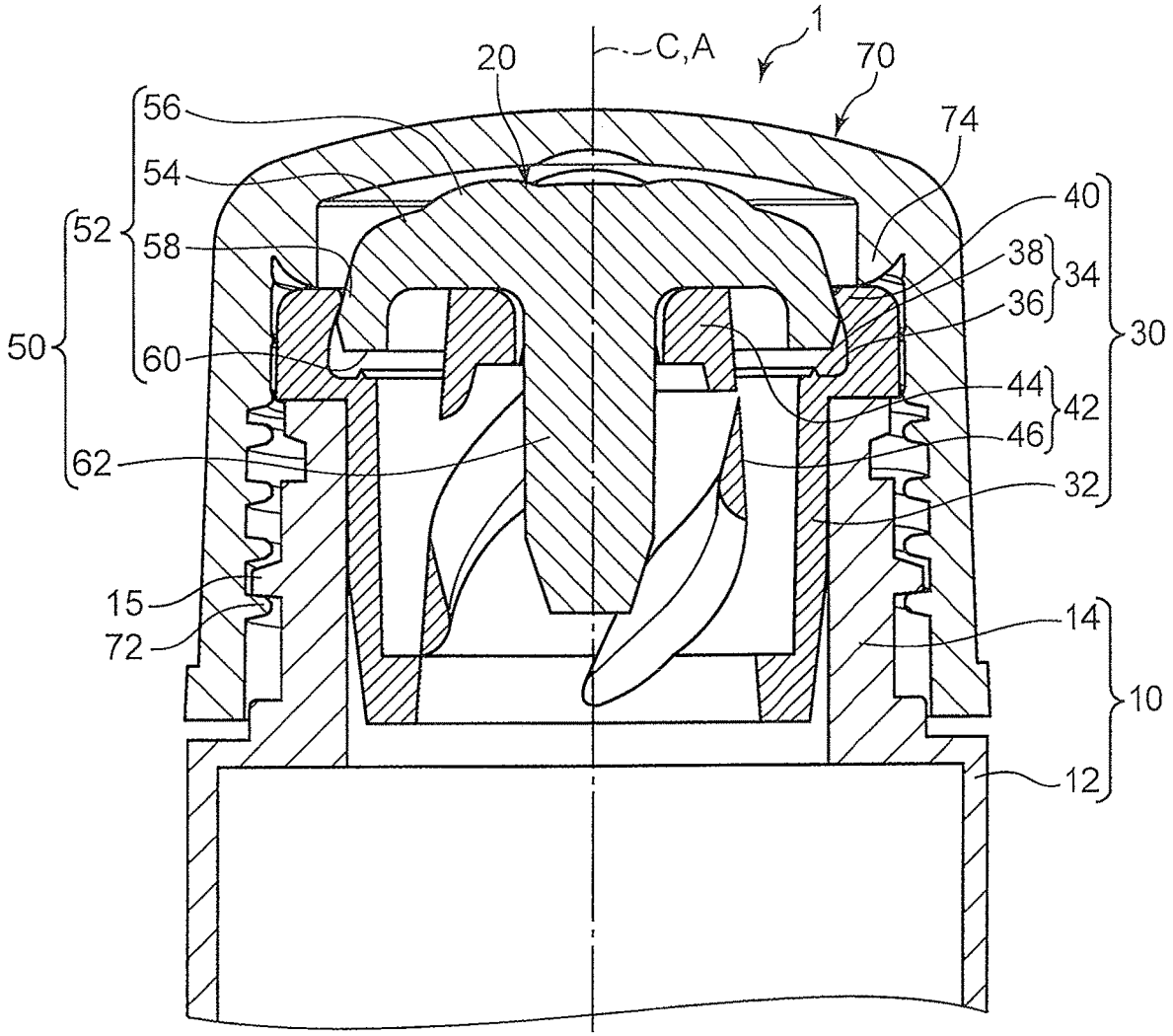
FIG. 1 is a cross-sectional view of a chemical solution supply apparatus according to a first embodiment of the present invention.

As shown in FIG. 1, the present chemical solution supply apparatus 1 includes a container 10, a chemical solution supply implement 20, and a cap 70.

The container 10 has a storage portion 12 for storing a chemical solution (not shown) and a mouth portion 14 joining the storage portion 12. The mouth portion 14 has a shape opening in a specific direction (vertical direction in FIG. 1). On an outer peripheral surface of the mouth portion 14, an external thread 15 is formed.

The chemical solution supply implement 20 is a unit that, in a state of being connected to the mouth portion 14, can switch over a state where the container 10 is sealed and a state where the chemical solution in the storage portion 12 is allowed to be supplied to the outside of the container 10. Specifically, the chemical solution supply implement 20 has a base 30 connectable to the mouth portion 14 and a supply body 50 held in the base 30.

The base 30 has a shape that, in a state of being connected to the mouth portion 14, allows communication between the inside of the container 10 and the outside of the container 10. The base 30 has a connected portion 32, a restricting portion 34, a retaining portion 40, and a pressing portion 42. In the present embodiment, the connected portion 32, the restricting portion 34, the retaining portion 40, and the pressing portion 42 are integrally molded. However, they may be formed as separate members.

The connected portion 32 is cylindrical. The outer diameter of the connected portion 32 is set to be slightly smaller than the inner diameter of the mouth portion 14.

The retaining portion 40 is positioned outside the container 10 when the connected portion 32 is connected (press-fitted) to the mouth portion 14. The retaining portion 40 comes into contact with the supply body 50 from the side opposite to the storage portion 12 with reference to the mouth portion 14 (upper side in FIG. 1) to prevent the detachment of the supply body 50 from the base 30. Specifically, the retaining portion 40 has a shape that comes into contact with the supply body 50 throughout the circumferential area around the central axis C of the connected portion 32.

The pressing portion 42 is connected to the inside of the connected portion 32, and presses the supply body 50 against the retaining portion 40. The pressing portion 42 has a holding portion 44 for holding the supply body 50 and an urging portion 46 for urging the holding portion 44 toward the outside of the container 10.

Figure 2:
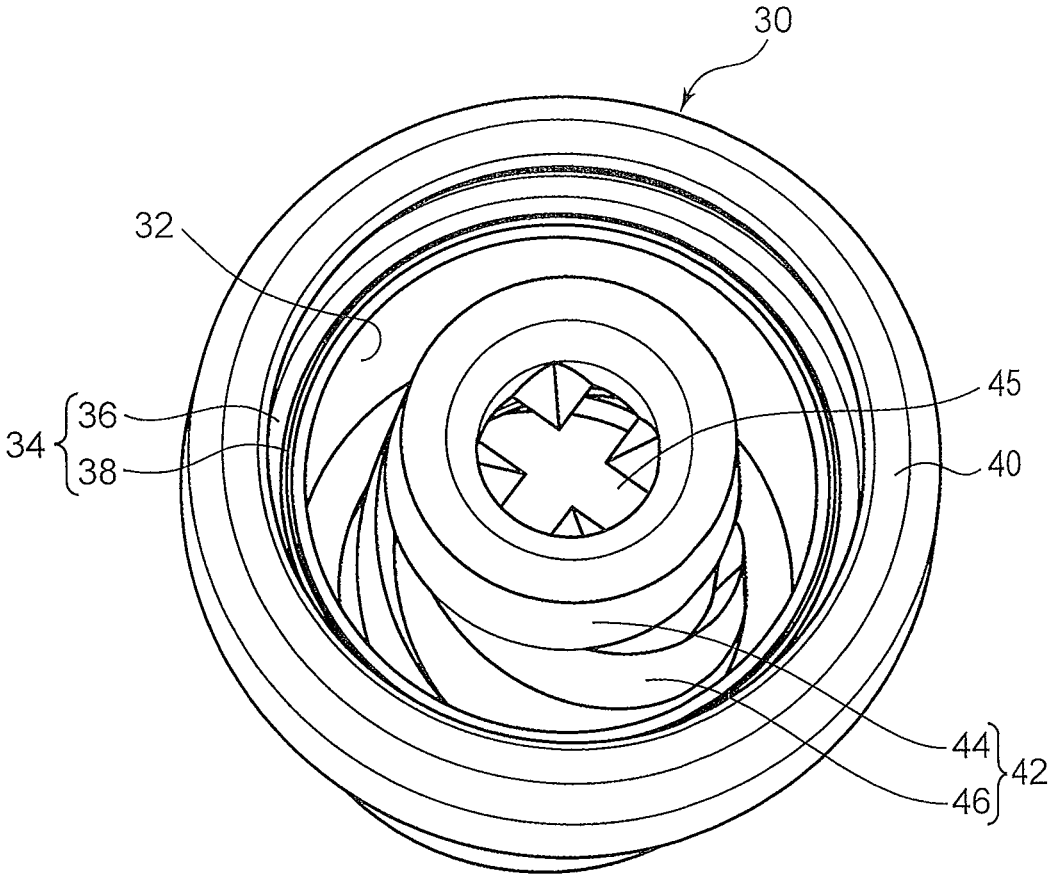
FIG. 2 is a perspective view of a base of the chemical solution supply apparatus shown in FIG. 1.

The holding portion 44 is displaceable along the central axis C inside the connected portion 32, in a state of holding the supply body 50. Specifically, the outer diameter of the holding portion 44 is smaller than the inner diameter of the connected portion 32. The holding portion 44 holds the supply body 50 in such a manner as to restrict the rotation of the supply body 50 around the central axis C that is parallel to the direction of action (upward in FIG. 1) of the urging force of the urging portion 46. In the present embodiment, as shown in FIG. 2, a cross-shaped groove 45 is formed in the holding portion 44. By inserting a shaft portion 62 to be described later of the supply body 50 into the groove 45, the relative rotation of the supply body 50 with respect to the base 30 is restricted.

Figure 3:
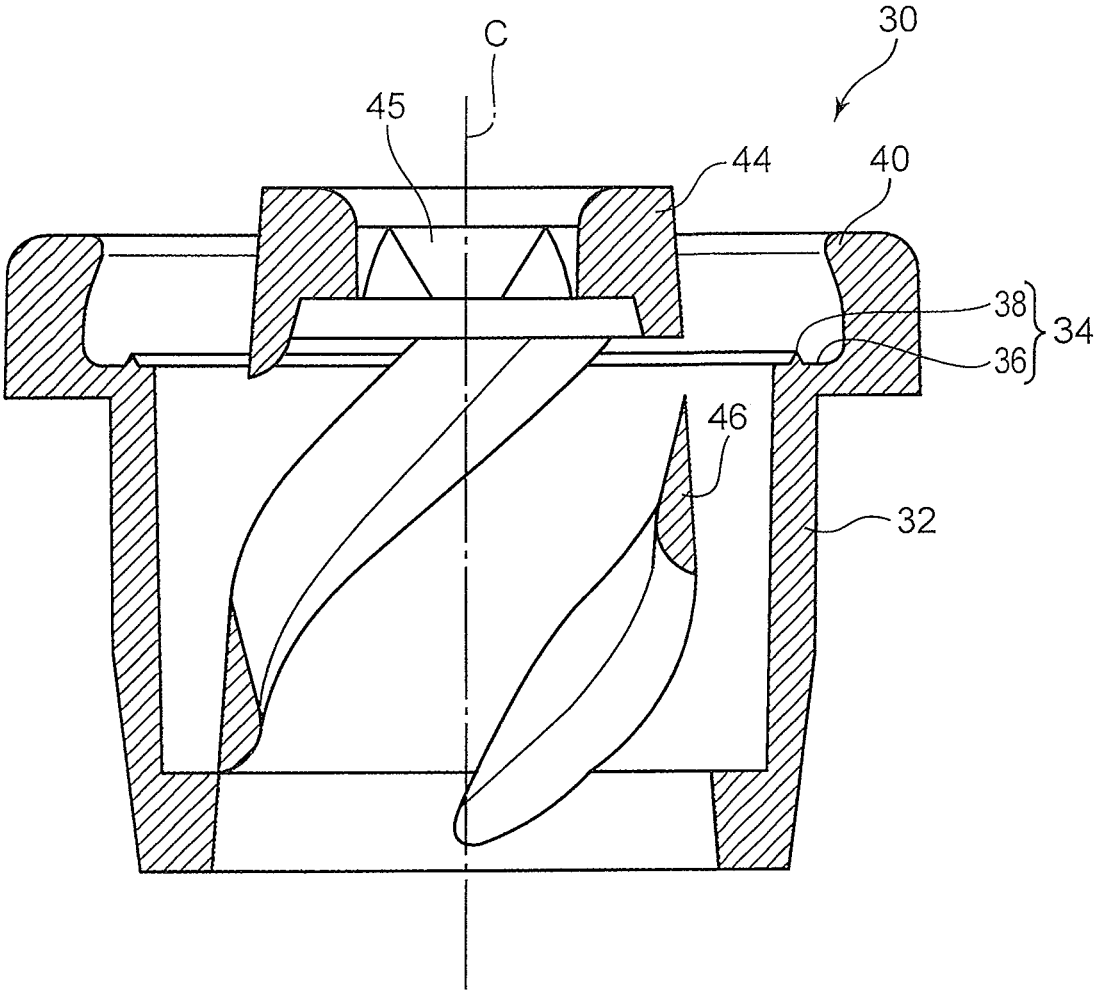
FIG. 3 is a cross-sectional view of the base of the chemical solution supply apparatus shown in FIG. 1.

The urging portion 46 is a helical spring member that connects an end portion of the inner peripheral surface of the connected portion 32 close to the storage portion 12 (on the lower side in FIG. 1) to the holding portion 44. The expansion and contraction of the urging portion 46 causes the holding portion 44, that is, the supply body 50 to be displaced in the direction parallel to the direction of action of the urging force of the urging portion 46. As shown in FIG. 3, the urging portion 46 at the natural length connects the connected portion 32 and the holding portion 44 so that the upper end face of the holding portion 44 is positioned above the retaining portion 40. As shown in FIG. 1, the urging portion 46 is compressed from the natural length in a state where the supply body 50 is in contact with the retaining portion 40. In other words, the urging portion 46 presses the supply body 50 against the retaining portion 40 at all times. FIG. 1 shows a state where the container 10 is sealed by the supply body 50 being pressed against the retaining portion 40.

The restricting portion 34 is formed between the connected portion 32 and the retaining portion 40. When the supply body 50 is pressed against the pressing force of the pressing portion 42, the restricting portion 34 comes into contact with the supply body 50, thereby restricting the displacement of the supply body 50. The restricting portion 34 has an annular restricting surface 36 orthogonal to the central axis C of the connected portion 32, and an annular protrusion 38 protruding outward from the restricting surface 36 and having a shape that is annular and has line contact with the supply body 50. It should be noted that the annular protrusion 38 may be omitted.

The supply body 50 is held in the base 30, and is operable to close the container 10 and supply the chemical solution to a part to be supplied (such as skin). Specifically, the supply body 50 has a supply body main body 52 and a shaft portion 62. The supply body main body 52 and the shaft portion 62 are integrally molded.

The supply body main body 52 has a supply surface 54 for supplying the chemical solution to a part to be supplied, a plurality of (three in the present embodiment) bulging portions 56, an abutting portion 58 to come into contact with the retaining portion 40, and an opposed portion 60 to be opposed to the restricting portion 34.

The supply surface 54 has a shape curved to protrude toward the outside of the container 10.

Figure 4:
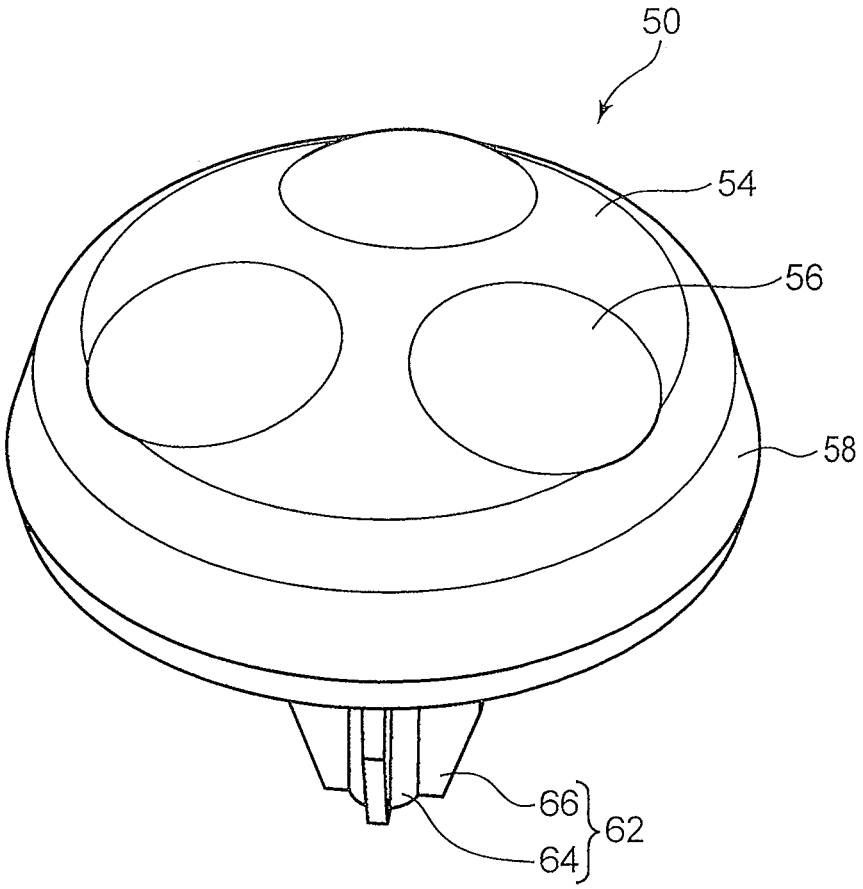
FIG. 4 is a perspective view of a supply body of the chemical solution supply apparatus shown in FIG. 1.
Figure 5:
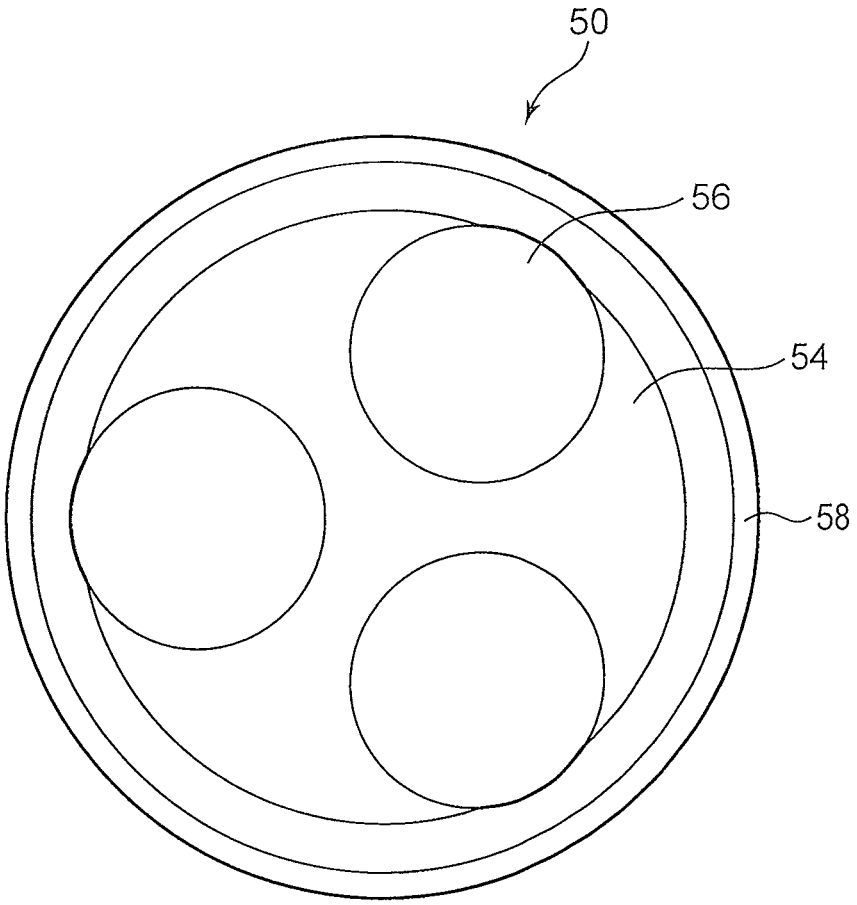
FIG. 5 is a plan view of the supply body of the chemical solution supply apparatus shown in FIG. 1.

Each bulging portion 56 has a shape bulging outward from the supply surface 54. In other words, the radius of curvature of each bulging portion 56 is set to be smaller than the radius of curvature of the supply surface 54. As shown in FIGS. 4 and 5, each bulging portion 56 is formed at a part of the supply surface 54 away from the center of the supply surface 54. In the present embodiment, the bulging portions 56 are arranged so as to be evenly spaced around the center.

Figure 7:
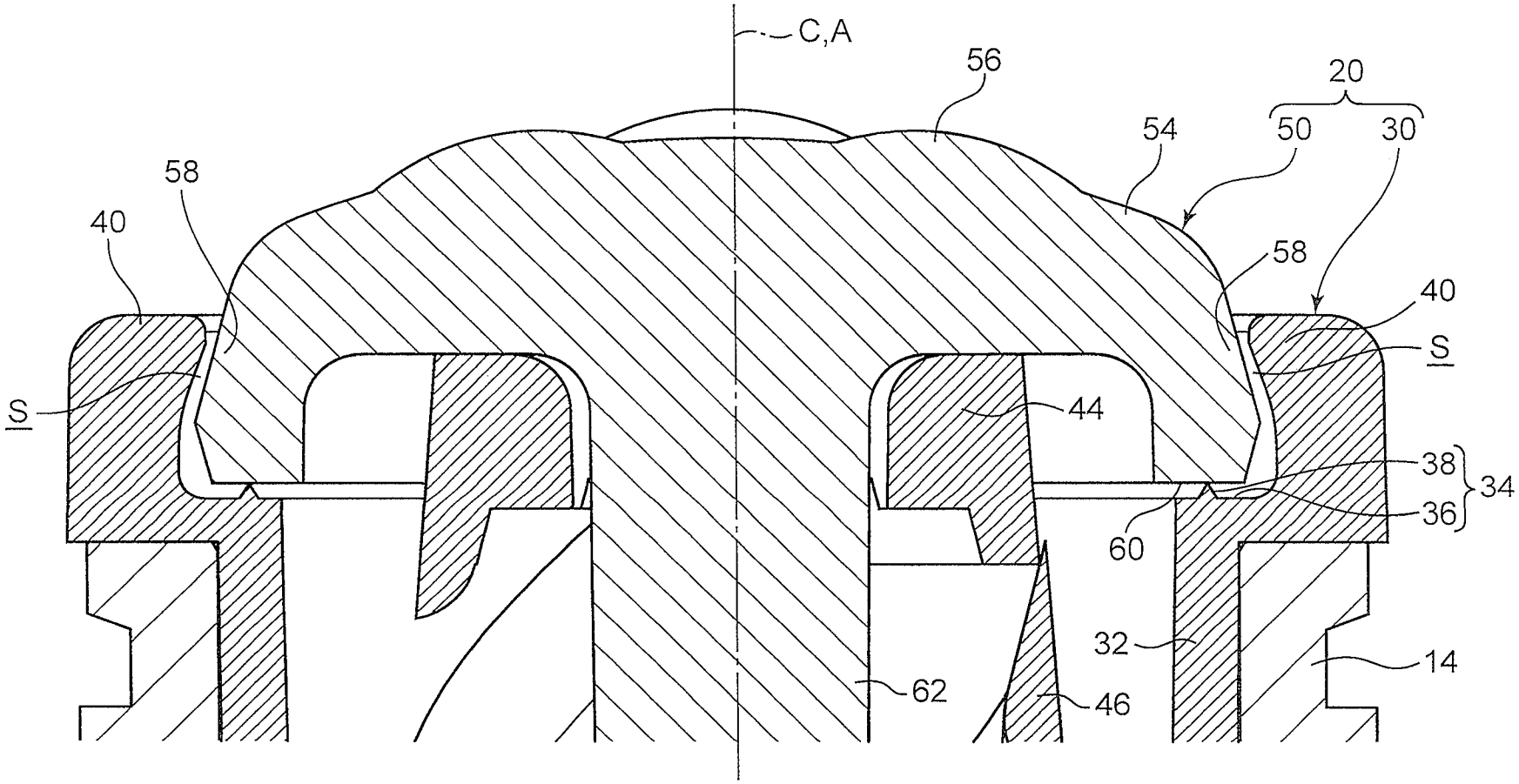
FIG. 7 is a cross-sectional view of a state where the supply body is pressed in the chemical solution supply apparatus shown in FIG. 1.

The abutting portion 58 comes into contact with the retaining portion 40 in the direction of action of the urging force (pressing force). The abutting portion 58 is connected to the outer edge of the supply surface 54. The abutting portion 58 is formed in a shape in which the outer diameter of the abutting portion 58 gradually increases with distance from the supply surface 54 (truncated cone shape). As shown in FIG. 7, the abutting portion 58 moves away from the retaining portion 40 to thereby form a supply flow passage S of the chemical solution to the outside of the container 10 between the supply body 50 and the retaining portion 40. In this state, the chemical solution is allowed to be supplied to a part to be supplied. As shown in FIG. 1, the abutting portion 58 comes into contact with (close contact with) the retaining portion 40 to thereby block the supply flow passage S. In this state, the container 10 is sealed.

Figure 6:
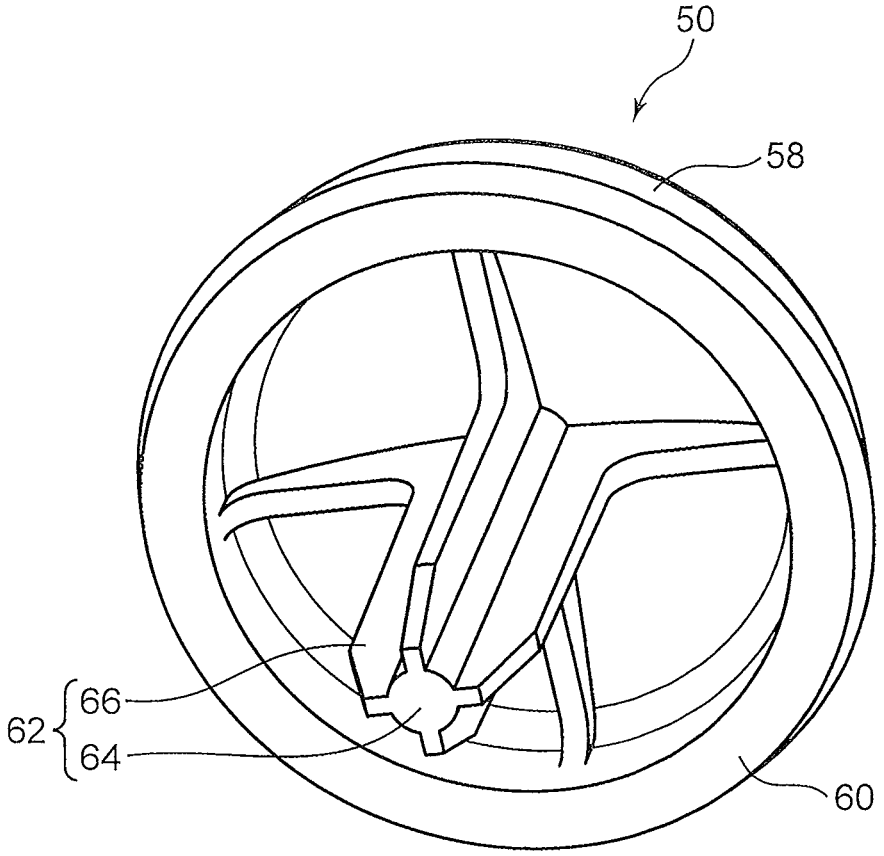
FIG. 6 is a perspective view of the supply body at an angle different from that in FIG. 4.

The shaft portion 62 has a shape extending from the surface of the supply body main body 52 opposite to the supply surface 54, perpendicularly to the surface. As shown in FIGS. 4 and 6, the shaft portion 62 has a central shaft 64 and a plurality of (four in the present embodiment) side plates 66.

The central shaft 64 is cylindrical. The central shaft 64 is set to have an outer diameter insertable into the groove 45 of the holding portion 44.

Each of the side plates 66 has a shape protruding from the central shaft 64 outward in the radial direction of the central shaft 64. Each of the side plates 66 is disposed at intervals of 90 degrees along the circumferential direction of the central shaft 64. Each of the side plates 66 is set to have a thickness insertable into the groove 45. By inserting these side plates 66 into the groove 45, the relative rotation of the supply body 50 around the central axis C with respect to the base 30 is restricted. Note that the term "restrict" as used herein does not mean not permitting relative rotation of the supply body 50 with respect to the base 30 at all, but rather means that the relative rotation is restricted such that the amount of displacement of the supply body 50 in the circumferential direction falls within a preset tolerance.

The opposed portion 60 is a part opposed to the restricting portion 34 in a state where the shaft portion 62 is inserted into the groove 45. The opposed portion 60 is formed flat. As shown in FIG. 7, when the supply surface 54 or the bulging portions 56 are pressed against the urging force of the urging portion 46, the opposed portion 60 comes into contact (line contact) with the annular protrusion 38 of the restricting portion 34. In this state, the outflow of the chemical solution to the outside of the container 10 is restricted.

Figure 8:
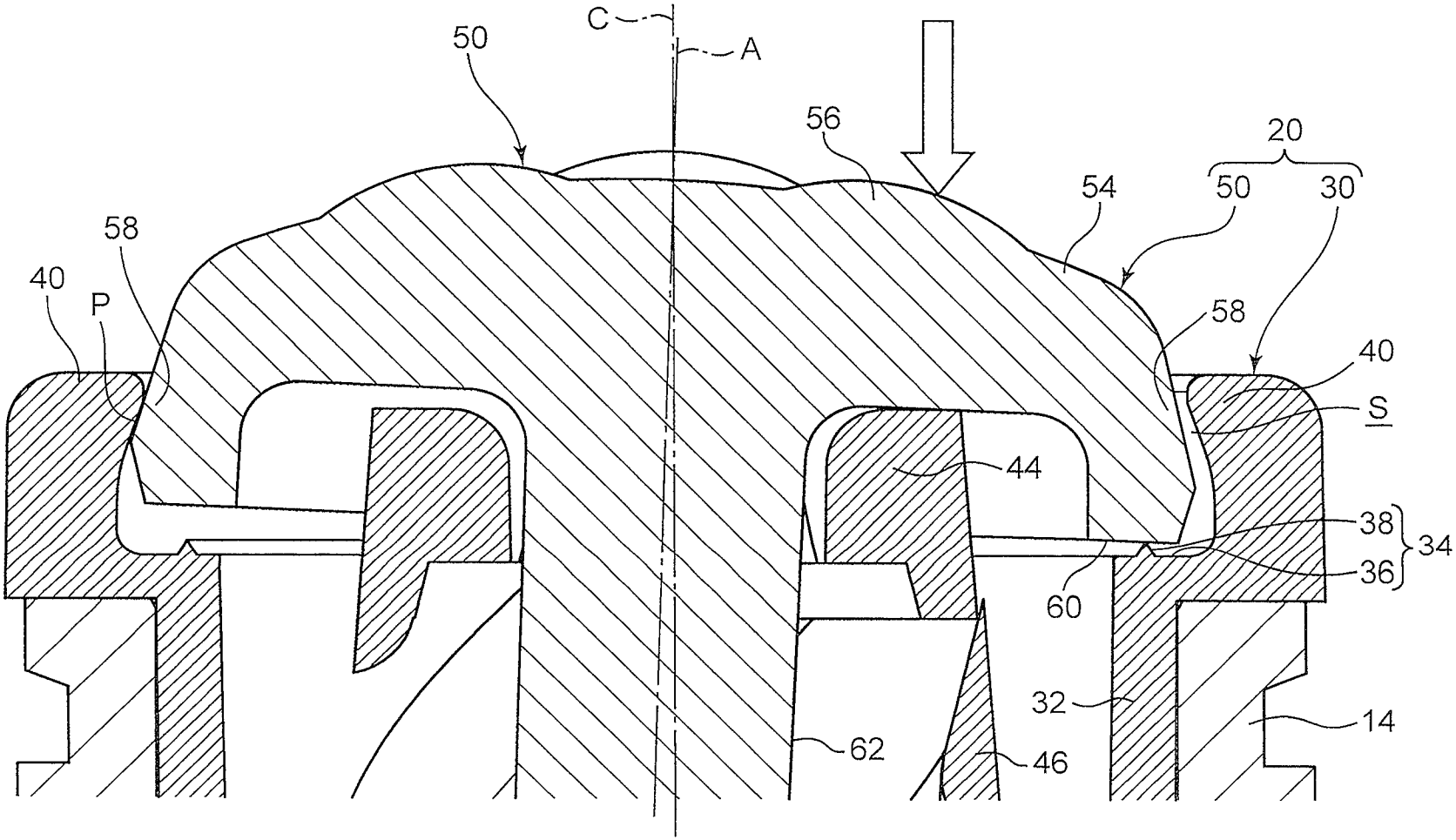
FIG. 8 is a cross-sectional view of a state where the supply body is inclined in the chemical solution supply apparatus shown in FIG. 1.

As shown in FIG. 8, the retaining portion 40 has a shape that allows the supply body 50 to incline in such a way that the central axis A of the shaft portion 62 inclines with respect to the central axis C. Specifically, the retaining portion 40 has a shape that allows, when an off-center portion (e.g. one bulging portion 56) of the supply body 50 away from the central axis A in a direction at right angles to the central axis A is pressed, the supply body 50 to tilt with respect to the base 30 until the opposed portion 60 comes into contact with the annular protrusion 38 with a contact point P between a part of the supply body 50 located opposite to the off-center portion with reference to the central axis A and the retaining portion 40 as a supporting point.

The cap 70 is screwed onto the mouth portion 14. Specifically, on an inner peripheral surface of the cap 70, an internal thread 72 to be meshed with the external thread 15 formed on the mouth portion 14 is formed. In addition, the cap 70 has an annular protruding portion 74 that comes into contact with the retaining portion 40, thereby sealing the container 10.

Next, a method of using the chemical solution supply apparatus 1 will be described. Hereinafter, the case where a part to be supplied is skin, that is, the case where the chemical solution is applied to skin using the present chemical solution supply apparatus 1 will be described.

First, the supply surface 54 is pressed against the skin in a position in which the supply surface 54 faces downward. At this time, the supply body 50 is pressed against the urging force of the urging portion 46 until the opposed portion 60 comes into contact with the annular protrusion 38. As a result, as shown in FIG. 7, the supply flow passage S is formed between the abutting portion 58 and the retaining portion 40, so that the chemical solution in the container 10 is supplied to the outside of the container 10 through the supply flow passage S. On the other hand, since the container 10 is sealed by the contact between the annular protrusion 38 and the opposed portion 60, further supply of the chemical solution is stopped.

Then, by moving the chemical solution supply apparatus 1 in that state along the skin, the chemical solution is applied to a desired area of the skin.

As described above, the present chemical solution supply apparatus 1 supplies the chemical solution through the supply flow passage S when the supply body 50 is pressed against the urging force of the urging portion 46, thus avoiding insufficient supply of the chemical solution. Further, the displacement (pressing stroke) of the supply body 50 is restricted by the supply body 50 coming into contact with the restricting portion 34, and thus excessive supply of the chemical solution through the supply flow passage S is prevented. Consequently, it is possible to keep the supply amount of the chemical solution within a certain range.

Further, in the present embodiment, since the restricting portion 34 has the annular protrusion 38 that has line contact with the opposed portion 60, the outflow of the chemical solution is effectively restricted by the opposed portion 60 coming into contact with the annular protrusion 38. Consequently, excessive supply of the chemical solution is prevented more reliably.

Further, since the holding portion 44 holds the supply body 50 to restrict the rotation of the supply body 50 around the central axis C parallel to the direction of action of the urging force, wear on the annular protrusion 38 is reduced. For example, if the supply body 50 is relatively rotatable with respect to the holding portion 44, the relative rotation of the supply body 50 with respect to the holding portion 44 in a state where the supply body 50 is in contact with the annular protrusion 38 causes wear on the annular protrusion 38. However, the present chemical solution supply apparatus 1 restricts the relative rotation of the supply body 50 with respect to the holding portion 44, thus reducing wear on the annular protrusion 38.

Further, since the retaining portion 40 has a shape that allows the supply body 50 to incline in such a way that the central axis A of the shaft portion 62 inclines with respect to the central axis C, even when the off-center portion of the supply body 50 is pressed, the supply flow passage S is ensured. Thus, the chemical solution can be smoothly supplied.

Further, since the relative rotation of the supply body 50 with respect to the holding portion 44 is restricted, an external force acting on the off-center portion of the supply body 50 tends to act as a pressing force in a direction to incline the supply body 50. Consequently, the supply body 50 is inclined easily, so that an effective amount of supply of the chemical solution is provided.

In addition, since each bulging portion 56 is formed at a part of the supply surface 54 away from the center of the supply surface 54, the bulging portion 56 when pressed facilitates the inclination of the supply body 50, whereby the supply flow passage S is effectively formed.

Second Embodiment

Next, a chemical solution supply apparatus 1 according to a second embodiment of the present invention will be described with reference to FIGS. 11 to 14. In the present embodiment, only the portions different from the first embodiment will be described, and the description of the same structure, action, effect, and the like as in the first embodiment will be omitted.

In the present embodiment, the bulging amount of the bulging portions 56 from the supply surface 54 is set to be larger than that of the first embodiment. Three reinforcing ribs 61 are formed on the back side of the bulging portions 56 (lower side in FIG. 11), more specifically, in positions overlapping with the bulging portions 56 in a direction parallel to the direction of action of the pressing force. The bulging portions 56 are formed inside the annular protrusion 38 in the radial direction of the annular protrusion 38. This also applies to the first embodiment.

The length of the shaft portion 62 is set to be shorter than that of the first embodiment.

Figure 11:
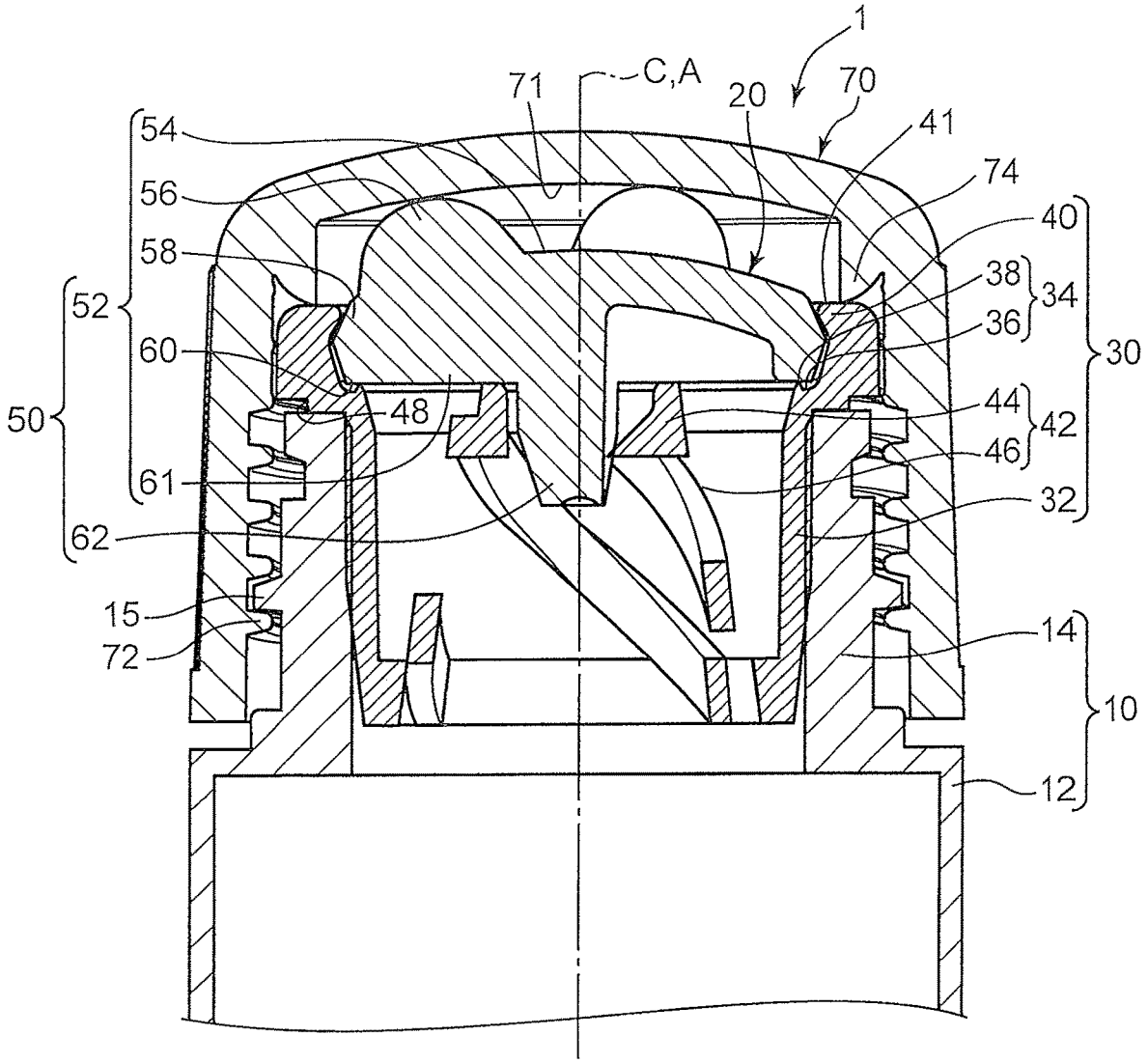
FIG. 11 is a cross-sectional view of a chemical solution supply apparatus according to a second embodiment of the present invention.
Figure 12:
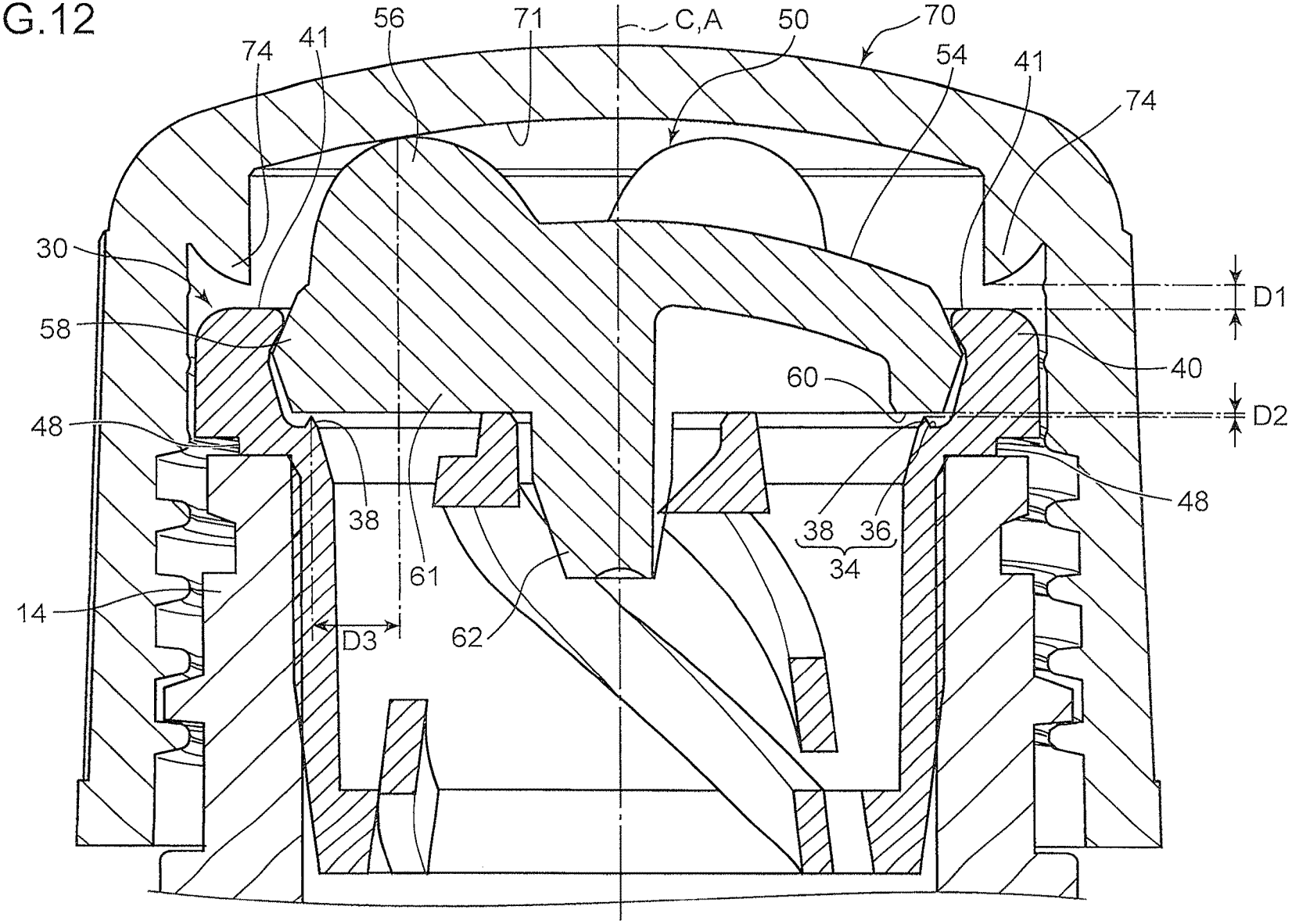
FIG. 12 is a cross-sectional view when a pressing surface of a cap comes into contact with bulging portions.
Figure 13:
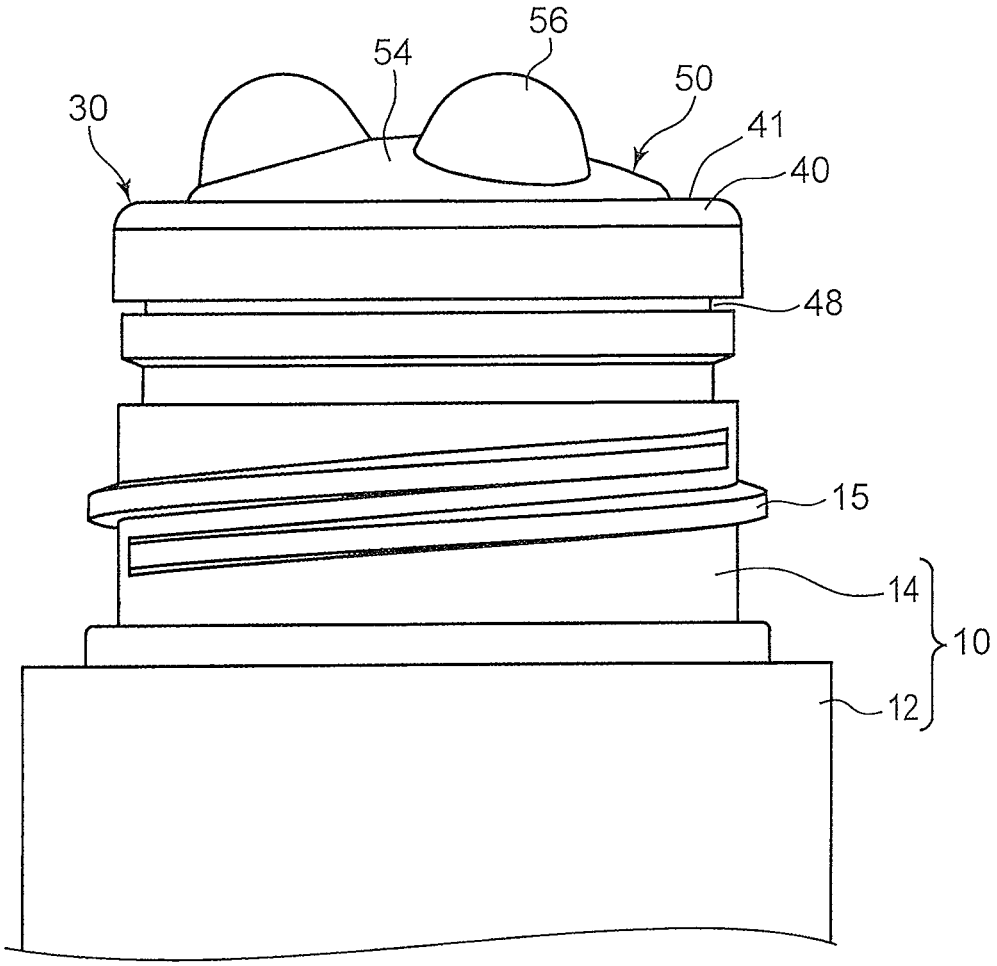
FIG. 13 is a side view showing a state where the cap is removed from the chemical solution supply apparatus shown in FIG. 11.
Figure 14:
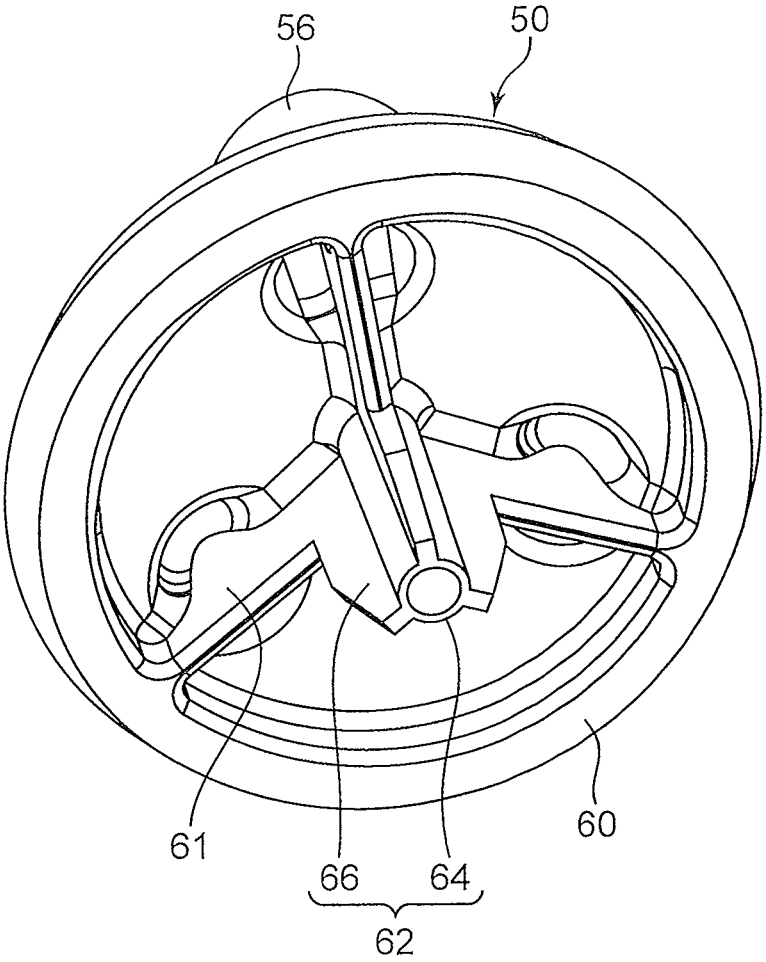
FIG. 14 is a perspective view of a supply body of the chemical solution supply apparatus shown in FIG. 11.

As shown in FIGS. 11 to 13, at an outer peripheral surface of the retaining portion 40, a chemical solution holding portion 48 for holding the chemical solution is formed. The chemical solution holding portion 48 has a shape that is recessed inward in the radial direction (the right and left direction in FIG. 11) of the retaining portion 40 from the other part of the outer peripheral surface of the retaining portion 40, and is continuous in the circumferential direction of the retaining portion 40. That is, the chemical solution holding portion 48 holds the chemical solution using a capillary phenomenon.

In the present embodiment, the cap 70 has a pressing surface 71 for pressing the supply body 50 so that the opposed portion 60 of the supply body 50 comes into contact with the annular protrusion 38 of the restricting portion 34 in a state where the cap 70 is connected (screwed) to the mouth portion 14. In other words, the bulging amount of the bulging portions 56 is set so that the opposed portion 60 is pressed against the annular protrusion 38 when the cap 70 is connected to the mouth portion 14.

In the present embodiment, the protruding portion 74 has a function of restricting the pressing amount of the pressing surface 71 against the supply body 50 in a state where the cap 70 is connected to the mouth portion 14. That is, in the present embodiment, the protruding portion 74 functions as a "stopper". The upper surface of the retaining portion 40 corresponds to a receiving portion 41 that receives the stopper.

FIG. 12 shows the moment when the pressing surface 71 comes into contact with the bulging portions 56 of the supply body 50 in the process of connecting (screwing) the cap 70 to the mouth portion 14. As shown in FIG. 12, the distance D1 between the stopper (protruding portion 74) and the receiving portion 41 when the pressing surface 71 comes into contact with the bulging portions 56 is larger than the distance D2 between the opposed portion 60 and the annular protrusion 38 when the pressing surface 71 comes into contact with the bulging portions 56. The distance D3 in the radial direction of the annular protrusion 38 from a contact portion (including point contact and surface contact) between the bulging portion 56 formed at the position closest to the central axis of the annular protrusion 38 among the bulging portions 56 and the pressing surface 71 to the annular protrusion 38 is preferably 0.1 or more times and 180 or less times, and more preferably 0.1 or more times and 90 or less times than the difference between the distance D1 between the stopper and the receiving portion 41 and the distance D2 between the opposed portion 60 and the annular protrusion 38 when the bulging portion 56 comes into contact with the pressing surface 71.

In the present embodiment, the base 30 is formed of a polyacetal resin (POM). As a result, the plastic deformation (reduction in urging force) of the urging portion 46 is prevented. The supply body 50 may also be formed of a polyacetal resin. However, it is preferable that the supply body 50 be formed of a resin material having a lower hardness than the polyacetal resin forming the base 30. In the present embodiment, since the ribs 61 are provided on the back side of the bulging portions 56, occurrence of sink marks on the bulging portions 56 when the supply body 50 is molded with the resin is prevented. Further, by providing the ribs 61 on the back side of the bulging portions 56, deformation of the supply surface 54 when the pressing force caused by the contact between the bulging portions 56 and the pressing surface 71 acts on the bulging portions 56 can be effectively prevented, compared to the case where the ribs 61 are provided out of alignment with the bulging portions 56, so that breakage (cracking or the like) of the supply surface 54 is prevented.

As described above, in the chemical solution supply apparatus 1 of the present embodiment, by connecting the cap 70 to the mouth portion 14, the supply body 50 comes into contact with the restricting portion 34, so that the container 10 is sealed. Consequently, the chemical solution is prevented from flowing out to the outside of the container 10 or the supply body 50.

Further, since the protruding portion 74 of the cap 70 constitutes the stopper and the retaining portion 40 has the receiving portion 41, and the distance D1 is larger than the distance D2, by screwing the cap 70 to the mouth portion 14, the contact of the supply body 50 with the restricting portion 34 is provided, and the pressing force of the supply body 50 caused by the pressing surface 71 on the restricting portion 34 is prevented from being excessive. In other words, both sealing of the container 10 and prevention of breakage of the supply body 50 are achieved.

Further, since the distance D3 is 0.1 or more times and 180 or less times than the difference between the distances D1 and D2, breakage of the supply body 50 is prevented more reliably.

It is to be understood that the embodiments disclosed this time are illustrative in all respects and are not limiting. The scope of the present invention is defined not by the description of the above embodiments but by the scope of the claims, and further includes all changes within meaning and scope equivalent to the scope of the claims.

For example, as long as the relative rotation of the supply body 50 around the central axis with respect to the base 30 is restricted, the shape of the groove 45 of the holding portion 44 and the shape of the shaft portion 62 are not limited to the above example.

Figure 9:
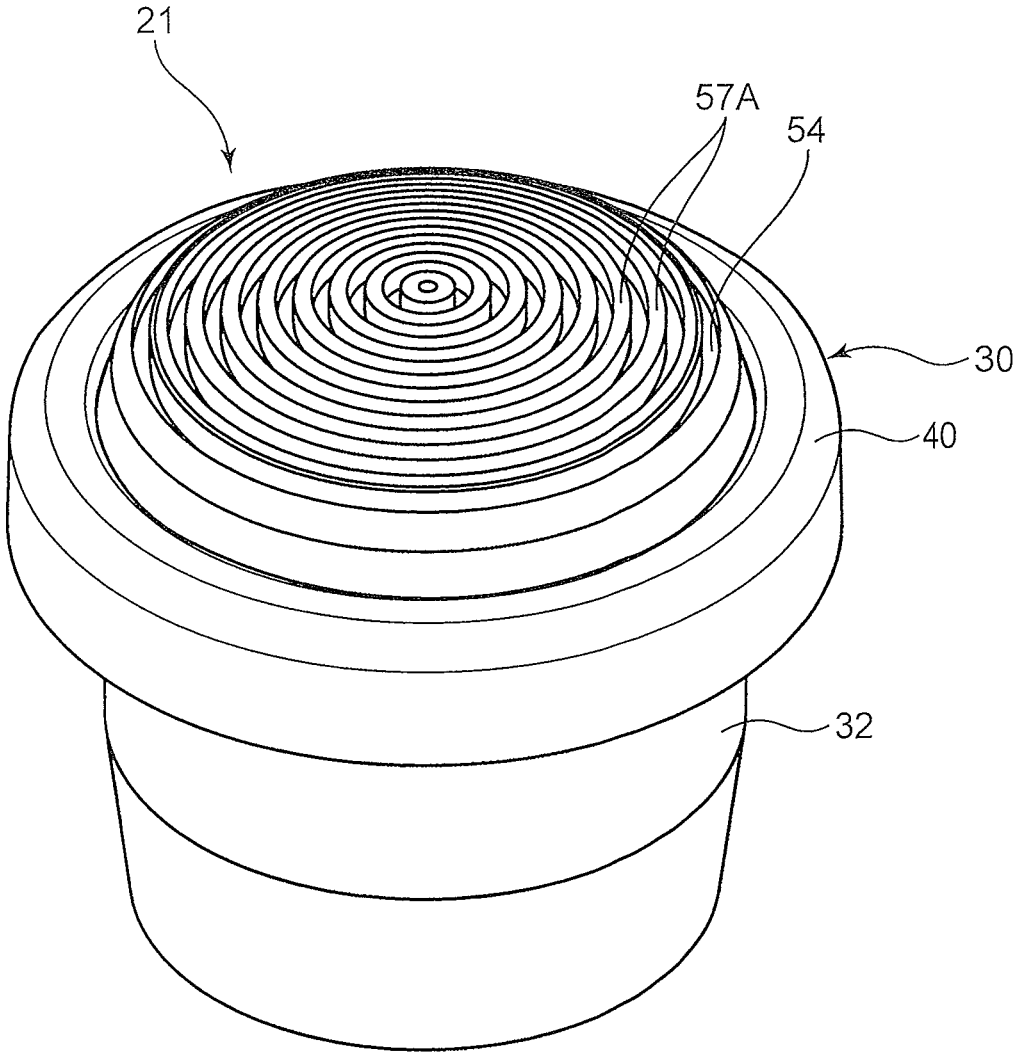
FIG. 9 is a perspective view of a first modification of a chemical solution supply implement.

FIG. 9 shows a first modification of the chemical solution supply implement 20 of the above embodiments. The chemical solution supply implement 21 has a resistance generating portion 57A formed on the supply surface 54. The resistance generating portion 57A makes the frictional resistance between the resistance generating portion 57A and a part to be supplied higher than the frictional resistance between the supply surface 54 and the part to be supplied. In this example, the resistance generating portion 57A is composed of a plurality of cylinders disposed concentrically around the central axis A. In this mode, when the chemical solution supply apparatus is moved along a part to be supplied (skin) from the state where the supply body 50 is pressed against the part to be supplied, the frictional resistance between the resistance generating portion 57A and the part to be supplied is higher than the frictional resistance between the supply surface 54 and the part to be supplied, so that the supply body 50 tends to be inclined with respect to the base 30. Consequently, the supply flow passage S is effectively formed. Further, the resistance generating portion 57A has a function of holding the chemical solution between the cylinders and a function of alleviating itching of the skin by stimulating the skin.

Figure 10:
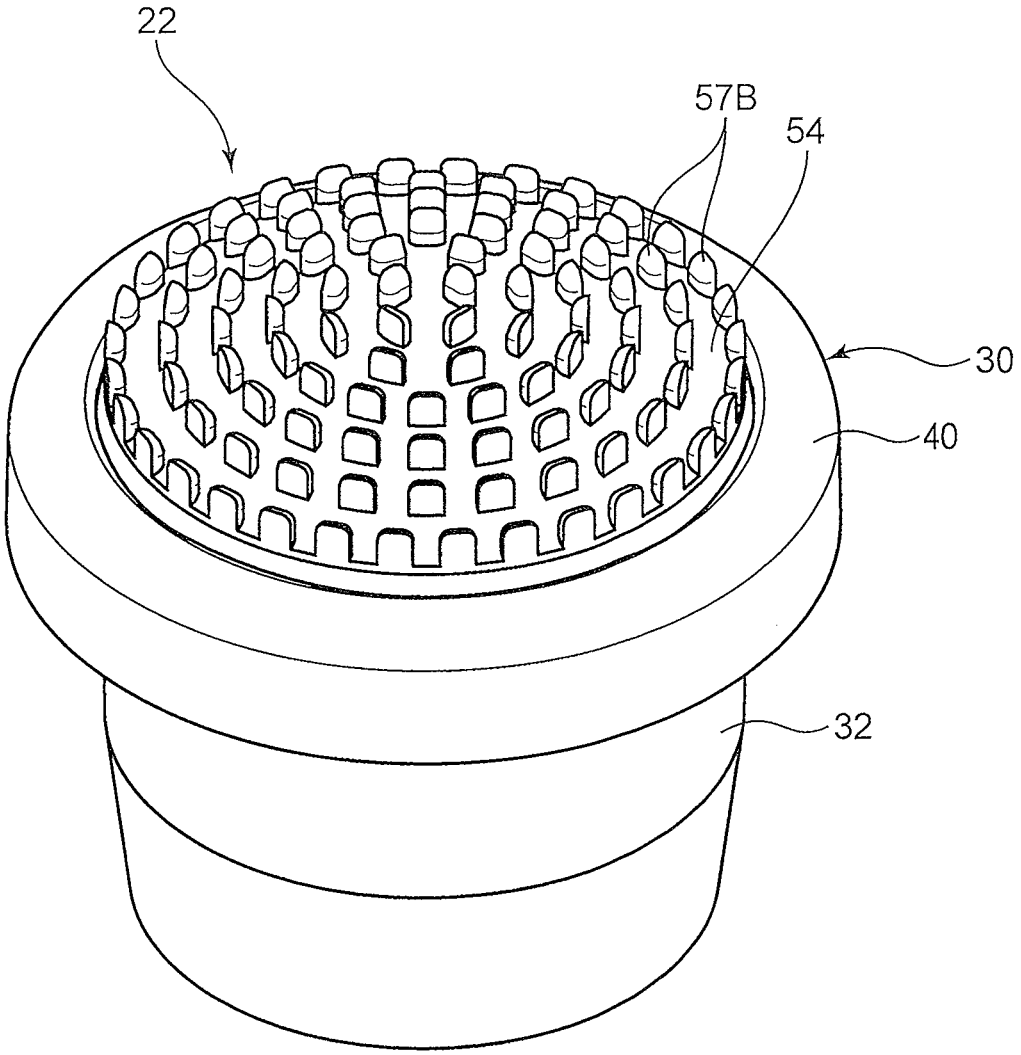
FIG. 10 is a perspective view of a second modification of the chemical solution supply implement.

FIG. 10 shows a second modification of the chemical solution supply implement 20 of the above embodiments. This chemical solution supply implement 22 also has a resistance generating portion 57B provided on the supply surface 54. In this example, the resistance generating portion 57B is composed of a plurality of small protrusions each protruding from the supply surface 54. Also in this mode, the same effect as that of the chemical solution supply implement 21 shown in FIG. 9 can be obtained.

The embodiments described above include the invention having the following configuration.

A chemical solution supply apparatus in the above embodiments includes a container having a storage portion operable to store a chemical solution and a mouth portion joining the storage portion and opening in a specific direction, and a chemical solution supply implement which is connectable to the mouth portion, and which is, in a state of being connected to the mouth portion, operable to switch over a state where the container is sealed and a state where the chemical solution in the storage portion is allowed to be supplied to the outside of the container. The chemical solution supply implement has a base connectable to the mouth portion and having a shape allowing communication between the inside of the container and the outside of the container, and a supply body held in the base for closing the container and supplying the chemical solution to a part to be supplied. The base has a retaining portion that comes into contact with the supply body from a side opposite to the storage portion with reference to the mouth portion to prevent detachment of the supply body from the base, a pressing portion that presses the supply body to the retaining portion to close the container, and a restricting portion that restricts displacement of the supply body with coming into contact with the supply body when the supply body is pressed against pressing force of the pressing portion. The supply body moves away from the retaining portion, thereby forming a supply flow passage of the chemical solution to the outside of the container between the supply body and the retaining portion, and comes into contact with the retaining portion, thereby blocking the supply flow passage.

In the present chemical solution supply apparatus, when the supply body is pressed against the pressing force of the pressing portion, the chemical solution is supplied through the supply flow passage, so that insufficient supply of the chemical solution is avoided. Further, since the displacement (pressing stroke) of the supply body is restricted by the supply body coming into contact with the restricting portion, excessive supply of the chemical solution through the supply flow passage is prevented. Consequently, it is possible to keep the supply amount of the chemical solution within a certain range.

In the chemical solution supply apparatus, the restricting portion preferably has an annular restricting surface orthogonal to a direction of action of the pressing force, and an annular protrusion protruding outward from the restricting surface and having a shape that is annular and has line contact with the supply body.

In this way, the outflow of the chemical solution is effectively restricted by the supply body coming into contact with the annular protrusion, so that excessive supply of the chemical solution is prevented more reliably.

In this case, the pressing portion preferably has a holding portion that holds the supply body to restrict rotation of the supply body around a central axis parallel to the direction of action of the pressing force.

In this way, wear on the annular protrusion is reduced. For example, if the supply body is relatively rotatable with respect to the holding portion, wear on the annular protrusion occurs when the supply body is relatively rotated with respect to the holding portion in a state where the supply body is in contact with the annular protrusion. However, the present chemical solution supply apparatus restricts the relative rotation of the supply body with respect to the holding portion, so that wear on the annular protrusion is reduced. Note that the term "restrict" as used herein does not mean not permitting relative rotation of the supply body with respect to the holding portion at all, but rather means that the relative rotation is restricted such that the amount of circumferential displacement of the supply body falls within a preset tolerance.

In the chemical solution supply apparatus, the retaining portion preferably has a shape that allows, when an off-center portion of the supply body away from a central axis parallel to a direction of action of the pressing force in a direction at right angles to the central axis is pressed, the supply body to tilt with respect to the base until the supply body comes into contact with the restricting portion with a contact point between a part of the supply body located opposite to the off-center portion with reference to the central axis and the retaining portion as a supporting point.

This allows the chemical solution to be smoothly supplied even when the off-center portion of the supply body is pressed. Specifically, the retaining portion has a shape that, when the off-center portion is pressed, allows the supply body to tilt with respect to the base until the supply body comes into contact with the restricting portion with the contact point between the supply body and the retaining portion as a supporting point, so that a supply flow passage is provided.

Further, in the chemical solution supply apparatus, the supply body preferably has a supply surface operable to come into contact with the part to be supplied, and at least one bulging portion formed at a part of the supply surface around a central axis parallel to a direction of action of the pressing force, and having a shape bulging outward from the supply surface.

This facilitates the inclination of the supply body when the bulging portion is pressed, so that the supply flow passage is effectively formed.

It is preferable that the chemical solution supply apparatus further include a cap removably connectable to the mouth portion and having a shape that covers the chemical solution supply implement in a state of being connected to the mouth portion, and the cap have a pressing surface that presses the supply body so that the supply body comes into contact with the restricting portion in a state where the cap is connected to the mouth portion.

In this way, by connecting the cap to the mouth portion, the supply body comes into contact with the restricting portion, so that the container is sealed. Consequently, the chemical solution is prevented from flowing out to the outside of the container or the supply body.

However, when the connection strength of the cap to the mouth portion is too large, that is, when the pressing force of the supply body caused by the pressing surface on the restricting portion is too large, the supply body may be damaged. Thus, it is preferable that in the chemical solution supply apparatus, one of the cap and the base have a stopper that comes into contact with the other of the cap and the base, and the other have a receiving portion that receives the stopper, or one of the cap and the container have a stopper that comes into contact with the other of the cap and the container, and the other have a receiving portion that receives the stopper, and a distance between the stopper and the receiving portion when the pressing surface comes into contact with the supply body be larger than a distance between the supply body and the restricting portion when the pressing surface comes into contact with the supply body.

In this way, by connecting the cap to the mouth portion, contact of the supply body with the restricting portion is provided, and the pressing force of the supply body caused by the pressing surface on the restricting portion is prevented from being excessive. In other words, both sealing of the container and prevention of breakage of the supply body are achieved.

In this case, it is preferable that the stopper be provided at the cap, and the receiving portion be provided at the base. In this way, the effect of tolerance of each member is reduced as compared with the case where the stopper is provided at the cap and the receiving portion is provided at the container, so that breakage of the supply body is prevented more reliably.

Further, in this case, it is preferable that the stopper have a shape protruding from the pressing surface in a direction opposite to a direction of action of the pressing force, and the receiving portion be formed at an outside end face of the retaining portion in the direction of action of the pressing force.

As compared with the case where the receiving portion has a shape protruding from the end face of the retaining portion in the direction of action of the pressing force (toward the cap), this mode avoids contact of the receiving portion with the skin when the chemical solution is supplied to the skin.

Further, it is preferable that in the chemical solution supply apparatus, the stopper have a shape annularly continuous around a central axis parallel to a direction of action of the pressing force.

In this way, since the stopper comes into contact with the receiving portion throughout the area around the central axis, breakage of the supply body is prevented more reliably. Further, since space inside the stopper is sealed by the stopper and the receiving portion, even when the chemical solution leaks to the outside of the supply body, the chemical solution is prevented from reaching the outside of the stopper (the outer peripheral surface side of the storage portion).

In the chemical solution supply apparatus, the restricting portion preferably has an annular restricting surface orthogonal to a direction of action of the pressing force, and an annular protrusion protruding outward from the restricting surface and having a shape that is annular and has line contact with the supply body.

Further, it is preferable that in the chemical solution supply apparatus, the supply body have a supply surface operable to come into contact the part to be supplied, and at least one bulging portion formed at a part of the supply surface around a central axis parallel to a direction of action of the pressing force, and having a shape bulging outward from the supply surface.

In the chemical solution supply apparatus, the at least one bulging portion may be a single bulging portion formed on a central axis of the annular protrusion.

Alternatively, the at least one bulging portion may include a plurality of bulging portions arranged intermittently so that contact portions between the bulging portions and the pressing surface are aligned concentrically with the annular protrusion, and the plurality of bulging portions may be formed inside the annular protrusion in a radial direction of the annular protrusion.

This mode increases the degree of freedom in the shape of each bulging portion, as compared with the case where each bulging portion is formed at a position overlapping the annular protrusion in a direction parallel to the central axis of the annular protrusion.

Further, in the chemical solution supply apparatus, a distance in a radial direction of the annular protrusion from a contact portion between the bulging portion formed at the position closest to the central axis of the annular protrusion among the at least one bulging portion and the pressing surface to the annular protrusion is preferably 0.1 or more times and 180 or less times, and more preferably 0.1 or more times and 90 or less times than a difference between the distance between the stopper and the receiving portion and a distance between an opposed portion and the annular protrusion when the bulging portion comes into contact with the pressing surface.

In this way, breakage of the supply body is prevented more reliably.

A chemical solution supply implement in the above embodiments is connectable to a mouth portion of a container having a storage portion operable to store a chemical solution and the mouth portion joining the storage portion and opening in a specific direction, and which is, in a state of being connected to the mouth portion, operable to switch over a state where the container is sealed and a state where the chemical solution in the storage portion is allowed to be supplied to the outside of the container. The chemical solution supply implement includes a base connectable to the mouth portion and having a shape allowing communication between the inside of the container and the outside of the container, and a supply body held in the base to close the container and supplying the chemical solution to a part to be supplied. The base has a retaining portion that comes into contact with the supply body from a side opposite to the storage portion with reference to the mouth portion to prevent detachment of the supply body from the base, a pressing portion that presses the supply body to the retaining portion to close the container, and a restricting portion that restricts displacement of the supply body with coming into contact with the supply body when the supply body is pressed against pressing force of the pressing portion. The supply body moves away from the retaining portion, thereby forming a supply flow passage of the chemical solution to the outside of the container between the supply body and the retaining portion, and comes into contact with the retaining portion, thereby blocking the supply flow passage.

By being connected to the mouth portion of the container, the present chemical solution supply implement supplies the chemical solution through the supply flow passage when the supply body is pressed against the pressing force of the pressing portion, so that insufficient supply of the chemical solution is avoided. Further, since the displacement (pressing stroke) of the supply body is restricted by the supply body coming into contact with the restricting portion, excessive supply of the chemical solution through the supply flow passage is prevented. Consequently, it is possible to keep the supply amount of the chemical solution within a certain range.

The invention claimed is:

1. A chemical solution supply apparatus, comprising:

a container having a storage portion for storing a chemical solution and a mouth portion joining the storage portion and opening in a specific direction; and a chemical solution supply implement which is connectable to the mouth portion, and which is, in a state of being connected to the mouth portion, operable to switch over a state where the container is sealed and a state where the chemical solution in the storage portion is allowed to be supplied to the outside of the container, wherein the chemical solution supply implement has:

a base connectable to the mouth portion and having a shape allowing communication between the inside of the container and the outside of the container, and a supply body including an abutting portion which comes into contact with the base to close the communication, the supply body being movably held in the base so that the abutting portion moves away from the base to thereby form the communication between the supply body and the base when the supply body is pressed, wherein the base having a retaining portion that comes into contact with the abutting portion from a side opposite to the storage portion with reference to the mouth portion to prevent detachment of the supply body from the base and to thereby block the communication, a pressing portion that presses the supply body to the retaining portion to close the container, and a restricting portion that restricts displacement of the supply body and closes the communication when the restricting portion comes into contact with the supply body when the supply body is pressed against pressing force of the pressing portion, and the supply body includes an opposed portion opposed to the restricting portion, and the supply body is configured so that a part of the opposed portion comes into contact with the restricting portion while a part of the abutting portion comes into contact with the retaining portion to incline the supply body in the base when an off-center portion of the supply body away from a central axis is pressed.

2. The chemical solution supply apparatus according to claim 1, wherein the restricting portion has an annular restricting surface orthogonal to a direction of action of the pressing force, and an annular protrusion protruding outward from the restricting surface and having a shape that is annular and has line contact with the supply body.

3. The chemical solution supply apparatus according to claim 2, wherein the pressing portion has a holding portion that holds the supply body to restrict rotation of the supply body around the central axis parallel to the direction of action of the pressing force.

4. The chemical solution supply apparatus according to claim 2, wherein the retaining portion has a shape that allows, when an off-center portion of the supply body away from a central axis parallel to a direction of action of the pressing force in a direction at right angles to the central axis is pressed, the supply body to tilt with respect to the base until the supply body comes into contact with the restricting portion with a contact point between a part of the supply body located opposite to the off center portion with reference to the central axis and the retaining portion as a supporting point.

5. The chemical solution supply apparatus according to claim 2, wherein the supply body has a supply surface operable to come into contact with the part to be supplied with the solution, and at least one bulging portion formed at a part of the supply surface around the central axis parallel to a direction of action of the pressing force, and having a shape bulging outward from the supply surface.

6. The chemical solution supply apparatus according to claim 1, wherein the retaining portion has a shape that allows, when an off-center portion of the supply body away from a central axis parallel to a direction of action of the pressing force in a direction at right angles to the central axis is pressed, the supply body to tilt with respect to the base until the supply body comes into contact with the restricting portion with a contact point between a part of the supply body located opposite to the off-center portion with reference to the central axis and the retaining portion as a supporting point.

7. The chemical solution supply apparatus according to claim 1, wherein the supply body has a supply surface operable to come into contact with the part to be supplied with the solution, and at least one bulging portion formed at a part of the supply surface around the central axis parallel to a direction of action of the pressing force, and having a shape bulging outward from the supply surface.

8. The chemical solution supply apparatus according to claim 1, further comprising:

a cap removably connectable to the mouth portion and having a shape that covers the chemical solution supply implement in a state of being connected to the mouth portion, wherein the cap has a pressing surface that presses the supply body so that the supply body comes into contact with the restricting portion in a state where the cap is connected to the mouth portion.

9. The chemical solution supply apparatus according to claim 8, wherein one of the cap and the base has a stopper that comes into contact with the other of the cap and the base, and the other has a receiving portion that receives the stopper, or one of the cap and the container has a stopper that comes into contact with the other of the cap and the container, and the other has a receiving portion that receives the stopper, and a distance between the stopper and the receiving portion when the pressing surface comes into contact with the supply body is larger than a distance between the supply body and the restricting portion when the pressing surface comes into contact with the supply body.

10. The chemical solution supply apparatus according to claim 9, wherein the stopper is provided at the cap, and the receiving portion is provided at the base.

11. The chemical solution supply apparatus according to claim 10, wherein the stopper has a shape protruding from the pressing surface in a direction opposite direction of action of the pressing force, and the receiving portion is formed at an outside end face of the retaining portion in the direction of action of the pressing force.

12. The chemical solution supply apparatus according to claim 9, wherein the stopper has a shape annularly continuous around the central axis parallel to a direction of action of the pressing force.

13. The chemical solution supply apparatus according to claim 9, wherein the restricting portion has an annular restricting surface orthogonal to a direction of action of the pressing force, and an annular protrusion protruding outward from the restricting surface and having a shape that is annular and has line contact with the supply body.

14. The chemical solution supply apparatus according to claim 13, wherein the supply body has a supply surface operable to come into contact with the part to be supplied with the solution, and at least one bulging portion formed at a part of the supply surface around the central axis parallel to a direction of action of the pressing force; and having a shape bulging outward from the supply surface.

15. The chemical solution supply apparatus according to claim 14, wherein the at least one bulging portion is a single bulging portion formed on the central axis of the annular protrusion.

16. The chemical solution supply apparatus according to claim 15, wherein a distance in a radial direction of the annular protrusion from a contact portion between the bulging portion formed at the position closest to the central axis of the annular protrusion among the at least one bulging portion and the pressing surface to the annular protrusion is 0.1 or more times and 180 or less times than a difference between the distance between the stopper and the receiving portion and a distance between an opposed portion and the annular protrusion when the bulging portion comes into contact with the pressing surface.

17. The chemical solution supply apparatus according to claim 14, wherein the at least one bulging portion includes a plurality of bulging portions arranged intermittently so that contact portions between the bulging portions and the pressing surface are aligned concentrically with the annular protrusion, and the plurality of bulging portions is formed inside the annular protrusion in a radial direction of the annular protrusion.

18. The chemical solution supply apparatus according to claim 17, wherein a distance in a radial direction of the annular protrusion from a contact portion between the bulging portion formed at the position closest to the central axis of the annular protrusion among the at least one bulging portion and the pressing surface to the annular protrusion is 0.1 or more times and 180 or less times than a difference between the distance between the stopper and the receiving portion and a distance between an opposed portion and the annular protrusion when the bulging portion comes into contact with the pressing surface.

19. A chemical solution supply implement connectable to a mouth portion of a container having a storage portion for storing a chemical solution and the mouth portion joining the storage portion and opening in a specific direction, and which is, in a state of being connected to the mouth portion, operable to switch over a state where the container is sealed and a state where the chemical solution in the storage portion is allowed to be supplied to the outside of the container, the chemical solution supply implement comprising:

a base connectable to the mouth portion and having a shape allowing communication between the inside of the container and the outside of the container; and a supply body including an abutting portion which comes into contact with the base to close the communication, the supply body being movably held in the base so that the abutting portion moves away from the base to thereby form the communication between the supply body, and the base when the supply body is pressed, wherein the base has a retaining portion that comes into contact with the abutting portion from a side opposite to the storage portion with reference to the mouth portion to prevent detachment of the supply body from the base and to thereby block the communication, a pressing portion that presses the supply body to the retaining portion to close the container, and a restricting portion that restricts displacement of the supply body and closes the communication when the restricting portion comes into contact with the supply body when the supply body is pressed against pressing force of the pressing portion, and the supply body includes an opposed portion opposed to the restricting portion, and the supply body is configured so that a part of the opposed portion comes into contact with the restricting portion while a part of the abutting portion comes into contact with the retaining portion to incline the supply body in the base when an off-center portion of the supply body away from a central axis is pressed.

* * * * *